United States Patent [19]

Yoshioka

[11] Patent Number: 4,823,576

[45] Date of Patent: Apr. 25, 1989

[54] APPARATUS FOR MANUFACTURING RING-SHAPED MEMBER FROM ELONGATE WORKPIECE

[75] Inventor: Shigeo Yoshioka, Bisai, Japan

[73] Assignee: Toyoda Gosei Co., Ltd., Nishikasugai, Japan

[21] Appl. No.: 105,029

[22] Filed: Oct. 6, 1987

[30] Foreign Application Priority Data

Oct. 20, 1986 [JP] Japan ..... 61-249233

[51] Int. Cl.[4] ..... B21F 1/00; B21F 11/00

[52] U.S. Cl. ..... 72/17; 72/131; 140/88

[58] Field of Search ..... 72/129, 131, 135, 142, 72/169, 170, 171, 173, 174, 6, 10, 17; 140/88, 140; 226/174, 178, 181, 189

[56] References Cited

U.S. PATENT DOCUMENTS

| | | | |
|---|---|---|---|
| 3,906,766 | 9/1975 | Sato | 72/132 X |
| 4,096,892 | 6/1978 | Guevara et al. | 140/140 |
| 4,112,721 | 9/1978 | Takase et al. | 72/132 X |
| 4,114,432 | 9/1978 | Miura et al. | 72/135 |
| 4,335,758 | 6/1982 | Williams | 140/88 |
| 4,583,675 | 4/1986 | Ochiai et al. | 72/167 X |

FOREIGN PATENT DOCUMENTS

| | | |
|---|---|---|
| 54-27430 | 2/1979 | Japan . |
| 56-11121 | 2/1981 | Japan . |

*Primary Examiner*—E. Michael Combs

*Attorney, Agent, or Firm*—Cushman, Darby & Cushman

[57] ABSTRACT

An apparatus for manufacturing a ring-shaped member from an elongate workpiece comprises a measuring mechanism for measuring an elongate workpiece straightened from a coiled elongate workpiece to a specified length, a feeding mechanism for feeding the measured length of the elongate workpiece, a coiling mechanism having bending rollers for bending the elongate workpiece fed by the feeding mechanism to a curved shape, and guide members for guiding a leading end portion of the bent elongate workpiece to form a coiled portion from the elongate workpiece, and a cutting mechanism for cutting the coiled portion off the elongate workpiece into a ring-shaped member.

1 Claim, 5 Drawing Sheets

APPARATUS FOR MANUFACTURING RING-SHAPED MEMBER FROM ELONGATE WORKPIECE

FIELD OF THE INVENTION

The present invention relates to an apparatus for manufacturing a ring-shaped member such as a ring-shaped core of a steering wheel, for example, from an elongate metallic workpiece.

DESCRIPTION OF THE RELATED ART

FIGS. 4 through 6 of the accompanying drawings shows an apparatus for manufacturing a ring-shaped member from an elongate workpiece.

The illustrated apparatus operates as follows. A coiled elongate workpiece 51 is uncoiled and drawn from a reel (not shown) by feed rollers 52. The elongate workpiece 51 is then passed through a set of three bending rollers 53 by which the workpiece 51 is bent into a curved shape.

A base 60 supports on its front surface a plurality of radial guide members 58 having guide pins 54 which guide the leading end portion of the elongate workpiece 51 to form a coiled portion 55, which is then cut off into a ring-shaped member 59 by a cutter 57. The ring-shaped member 59 is pushed off the guide members 58 by pushers 63 and slides on a guide bar 64 toward a position in front of the base 60.

For successively producing ring-shaped members 59, the elongate workpiece 51 is fed by the feed rollers 52 until the leading end of the coiled portion 55 abuts against a stopper 56 fixed near the cutter 57, and the coiled portion 55 is quickly cut off by the cutter 57. At this time, since the feed rollers 52 still continuously feed the elongate workpiece 51, the elongate workpiece 51 is additionally fed along slightly.

Such additional feeding of the elongate workpiece 51 causes the coiled portion 55 to be deflected radially outwardly out of the desired shape as indicated by the two-dot-and-dash lines in FIG. 5 between two guide members 58. This phenomena is particularly noticeable if the elongate workpiece 51 is small in diameter, since the coiled portion 55 is easily bendable.

Because of the above problem, ring-shaped members 59 manufactured by the illustrated apparatus tend to vary in their circumferential lengths. Where the variation of circumferential lengths is great, and if the ring shaped members 59 are used as the cores of steering wheels, some steering wheel cores may not have prescribed dimensions, and may be of irregular sizes.

One solution would be to employ a curved plate extending between the guide members 58 along the outer peripheral surface of the coiled portion 55, instead of the guide pines 54 on the guide members 58. Such a curved plate would however be of a constant curvature that cannot be varied even if a main bevel gear 61 were rotated to cause driven bevel gears 62 meshing therewith and coupled to the inner ends of the guide members 58, as shown in FIG. 6, to move the guide members 58 radially in an attempt to change the radius of curvature of the coiled portion 55.

SUMMARY OF THE INVENTION

It is an object of the present invention to provide an apparatus for manufacturing a ring-shaped member from an elongate workpiece, the apparatus having means for feeding the elongate workpiece of a constant length precisely at all times so that any variations or irregularities in the circumferential lengths of produced ring-shaped memb;ers will be held to a minimum.

To achieve the above object, there is provided an apparatus for manufacturing a ring-shaped member from an elongate workpiece, comprising measuring means for measuring an elongate workpiece straightened from a coiled elongate workpiece to a specified length, feeding means for feeding the measured length of the elongate workpiece, coiling means having bending roller for bending the elongate workpiece fed by the feeding means to a curved shape, and guide members for guiding a leading end portion of the bent elongate workpiece to form a coiled portion from the elongate workpiece, and cutting means for cutting the coiled portion off the elongate workpiece into a ring-shaped member.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1A:
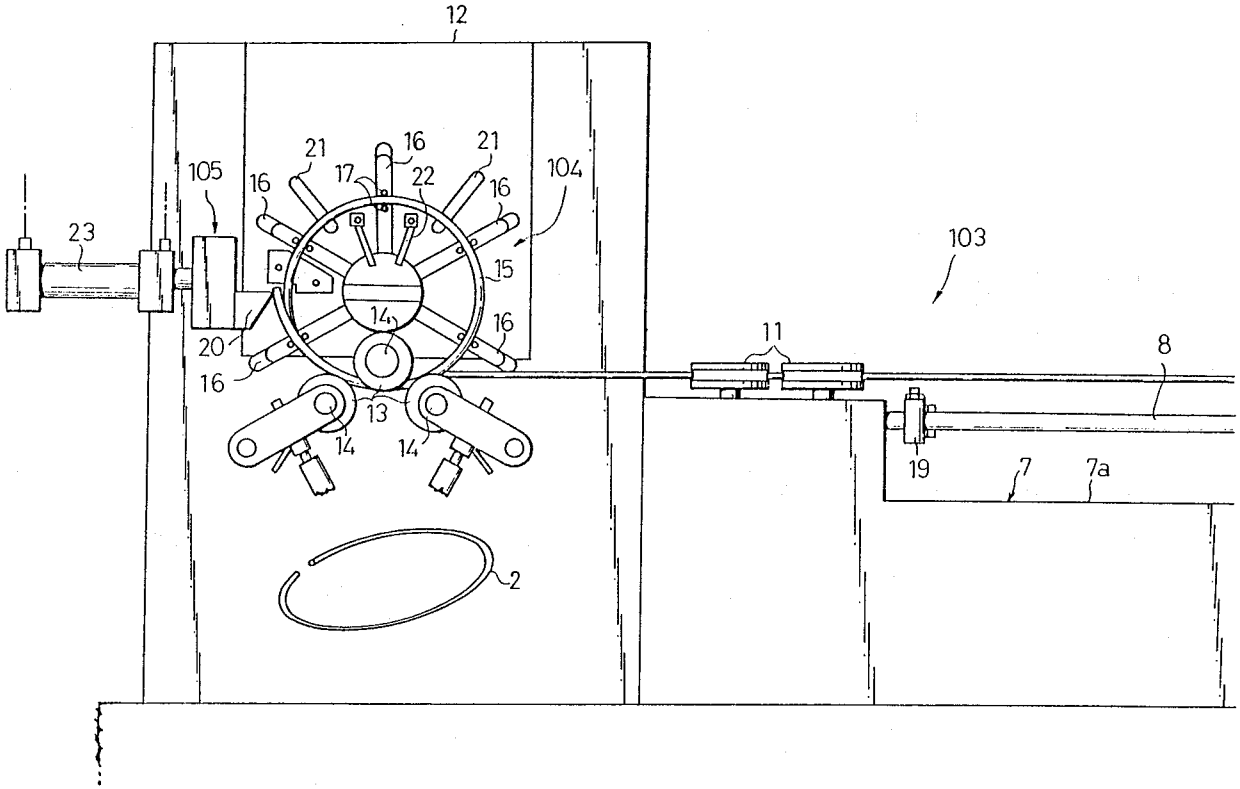
FIGS. 1(*a*) and 1(*b*) are a front elevational view of an apparatus according to a first embodiment of the present invention.

An apparatus for manufacturing a ring-shaped member from an elongate workpiece according to a first embodiment will be described with reference to FIGS. 1(*a*), 1(*b*), and 2.

The apparatus basically comprises straightening means 101 for straightening a coiled elongate workpiece 1, measuring means 102 for measuring the straightened elongate workpiece 1 to a constant length, feeding means 103 for feeding along the elongate workpiece 1, coiling means 104 for bending the elongate workpiece 1 into a coiled portion 15, and cutting means 105 for cutting the coiled portion 15 off the elongate workpiece 1 into a ring-shaped member 2. More specifically, as shown in FIG. 1(*b*), a pair of guide rollers 3 is mounted on a base 5 for guiding the elongate workpiece 1 that is coiled.

The straightening means 101 includes a set of five straightening rollers 4 mounted on a base 6 for straightening the elongate workpiece 1 that has passed through the guide rollers 3, the rollers 4 including two lower aligned rollers and three upper aligned rollers and being in a zigzag pattern as a whole. The elongate workpiece 1 is straightened while it is being passed between the upper and lower groups of rollers 4.

Figure 1B:
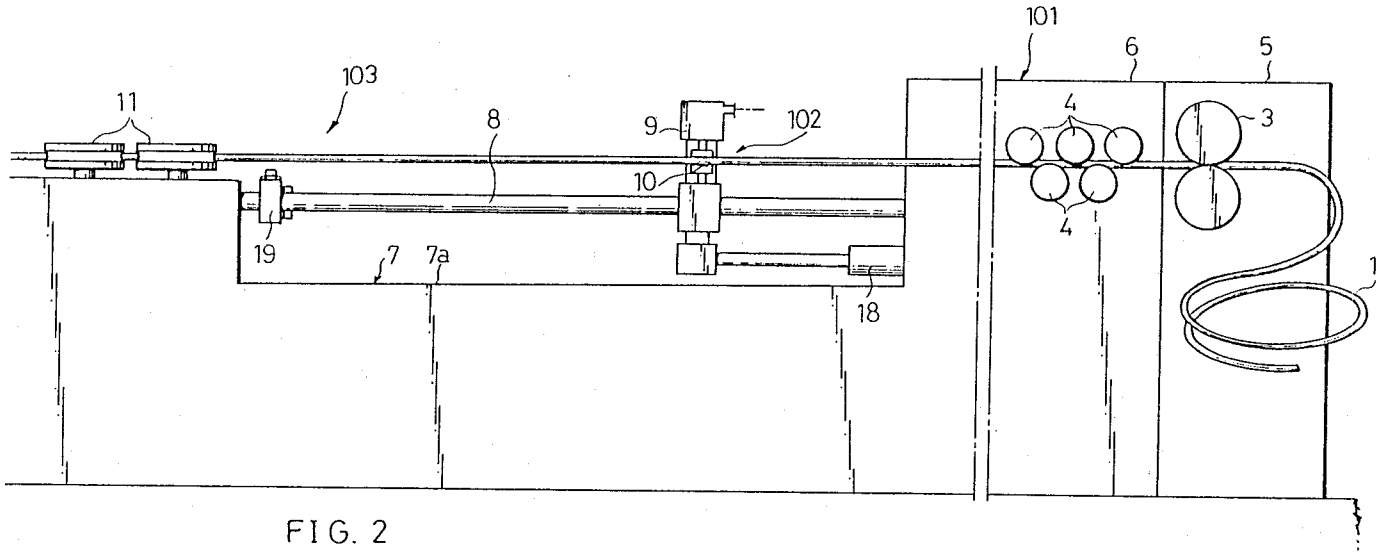
Figure 2:
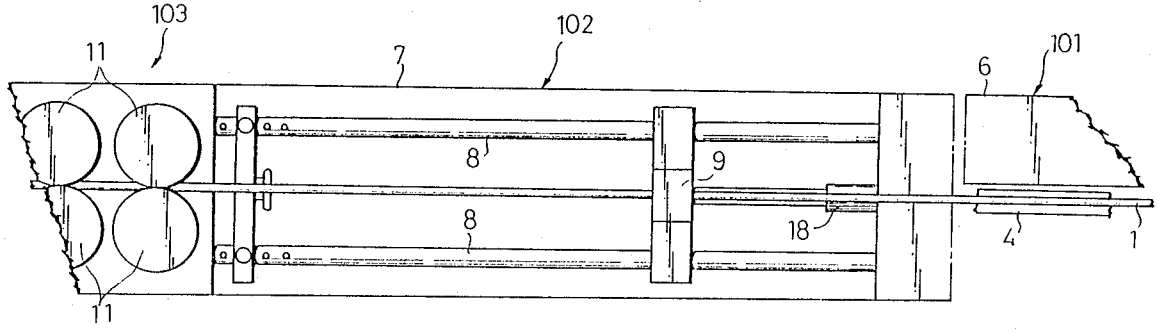
FIG. 2 is a fragmentary plan view of the apparatus.

Feed rollers 11 are disposed leftwardly (leftwardly in FIG. 1(*a*), 1(*b*), and hereinunder, "right" or "left" used in the description of the embodiments indicates respectively the right orl eft in FIGS. 1(*a*), 1(*b*)) of a base 7 for feeding the elongate workpiece 1. The base 7 has a central recess 7*a* opening upwardly and in which two parallel support bars 8 extend horizontally between the righthand and lefthand ends of the base 7. Grip means 9 is slidably mounted on the two support bars 8 for sliding movement along the base 7.

The grip means 9 has on its upper portion fingers 10 for gripping the elongate workpiece 1 at its upper and lower surfaces. With the fingers 10 gripping the elongate workpiece 1, the grip means 9 is moved to the left as the elongate workpiece 1 moves. The grip means 9 is connected at its lower portion to an air cylinder 18 which serves as moving means for retracting the grip means 9 to the right from the advanced position. A stopper 19 is mounted on the support bars 8 at the lefthand end of the base 7 for stopping the grip means 9 which grips the elongate workpiece 1 and has moved therewith, so that the elongate workpiece 1 can be measured to the prescribed length.

When the grip means 9 abuts against the stopper 19, a limit switch (not shown) is turned on to enable ;the fingers 10 of the grip means 9 to release the elongate workpiece 1, and also to actuate the air cylinder 18 to retract the grip means 9 to the measuring start position.

As illustrated in FIG. 1(*a*), the coiling means 104 has a base 12 on which a set of three bending rollers 13 are mounted for bending the elongate workpiece 1fed from the feed rollers 11 into a curved shape, the bending rollers 13 having support shafts 14 disposed at the vertexes of a triangle.

Five guide members 16 are substantially radially mounted on the front face of the base 12 above the bending rollers 13 for guiding the leading end portion of the bent elongate workpiece 1 to form a coiled portion 15. The guide members 16 are slidable in the radial direction. A pair of guide pins 17 is perpendicularly mounted on each of the guide members 16, the guide pins 17 being spaced apart from each other by a distance slightly larger than the diameter of the elongate workpiece 1 for guiding the leading end portion thereof therebetween.

Pushers 21 are disposed on both sides of the uppermost vertical guide members 16 near the upper portion thereof for pushing the ring-shaped member 2. The cutting means 105 for cutting off the coiled portion 15 is located leftwardly of the coiling means 104. The cutting means 105 comprises a cutter blade 20 horizontally movable by moving means 23. The coiled portion 15 formed on the leading end side of the elongate workpiece 1 is cut off by the cutter blade 20 to a ring-shaped member 2. The base 12 supports thereon two guide bars 22 for guiding the cut-off ring-shaped member 2 toward a position in front of the base 12.

Operation of the apparatus thus constructed is as follows:

Prior to operation of the apparatus, the coiled elongate workpiece 1 is unreeled off a reel (not shown) and manually threaded by the operator through the straightening means 101, the measuring means 102, the feeding means 103, and the coiling means 104. Thereafter, the elongate workpiece 1 is gripped by the grip means 9 positioned in the righthand measuring start position.

When the apparatus is started, the elongate workpiece 1 is straightened out of a curved configuration while it is being advanced by the straightening rollers 4 of the straightening means 101.

The elongate workpiece 1 is fed along by the feed rollers 11 of the feeding means 103. Since the fingers 10 of the grip means 9 of the measuring means 102 grips the elongate workpiece 1 at this time, the grip means 9 also moves with the elongate workpiece 1 to the left.

The grip means 9 then abuts against the stopper 19, thus turning on the limit switch. The feed rollers 11 are stopped and the air cylinder 18 is actuated to return the grip means 9 to the righthand measuring start position. The elongate workpiece 1 is thus fed toward the coiling means 104 accurately for the length equal to the stroke of the air cylinder 18 (i.e., the distance from the righthand measuring start position to the lefthand stop position of the grip means 9).

The elongate workpiece 1 thus fed is bent into a curved shape by the bending rollers 13. The leading end portion of the elongate workpiece 1 is then guided by the guide pins 17 to form a coiled portion 15. Simultaneously with the actuation of the limit switch, the feed rollers 11 stop feeding the elongate workpiece 1, and the cutter blade 20 of the cutting means 104 is operated to cut off the coiled portion 15, which is delivered as a ring-shaped portion 2 on the guide bars 22 toward a position in front of the base 12.

The measuring means 102 and the feeding means 103 cooperate with each other in accurately measuring and feeding the elongate workpiece 1 for the length required to produce the ring-shaped member 2. As the coiled portion 15 is not deflected out between adjacent ones of the guide members 16, any variations or irregularities of the circumferential lengths of produced ring-shaped members 2 are greatly reduced. According to an experiment, in the case of producing ring-shaped members which are 1130 mm in circumferential length, the error was ±0.25 mm, which was much smaller than ±0.75 mm of the related art.

Accordingly, where ring-shaped members produced by the present apparatus are employed as steering wheel cores, their sizes are very close to each other and the obtained steering wheel cores are of good quality which meet desired dimensional standards.

Figure 3:
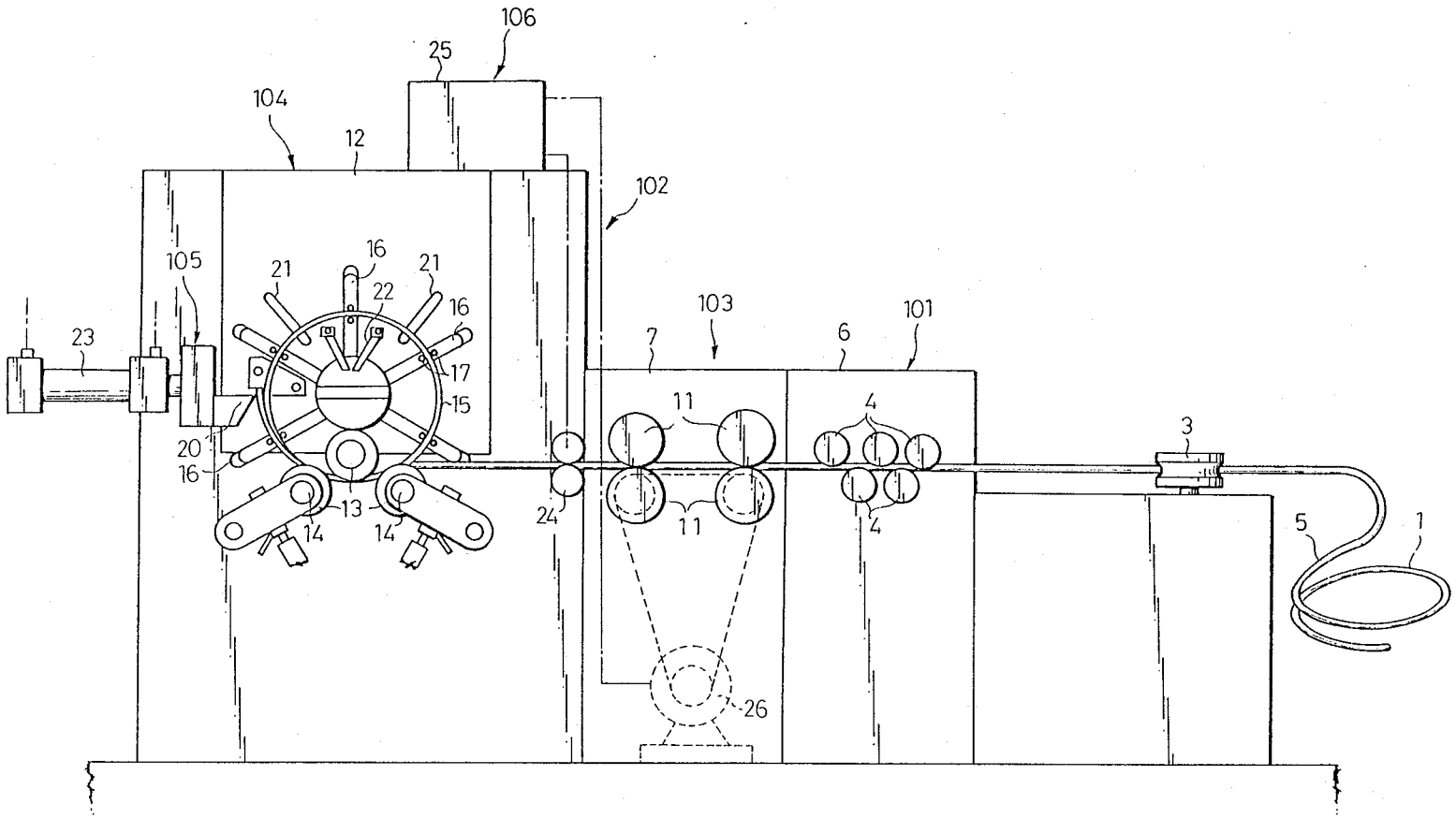
FIG. 3 is a front elevational view of an apparatus according to a second embodiment of the present invention.
Figure 4:
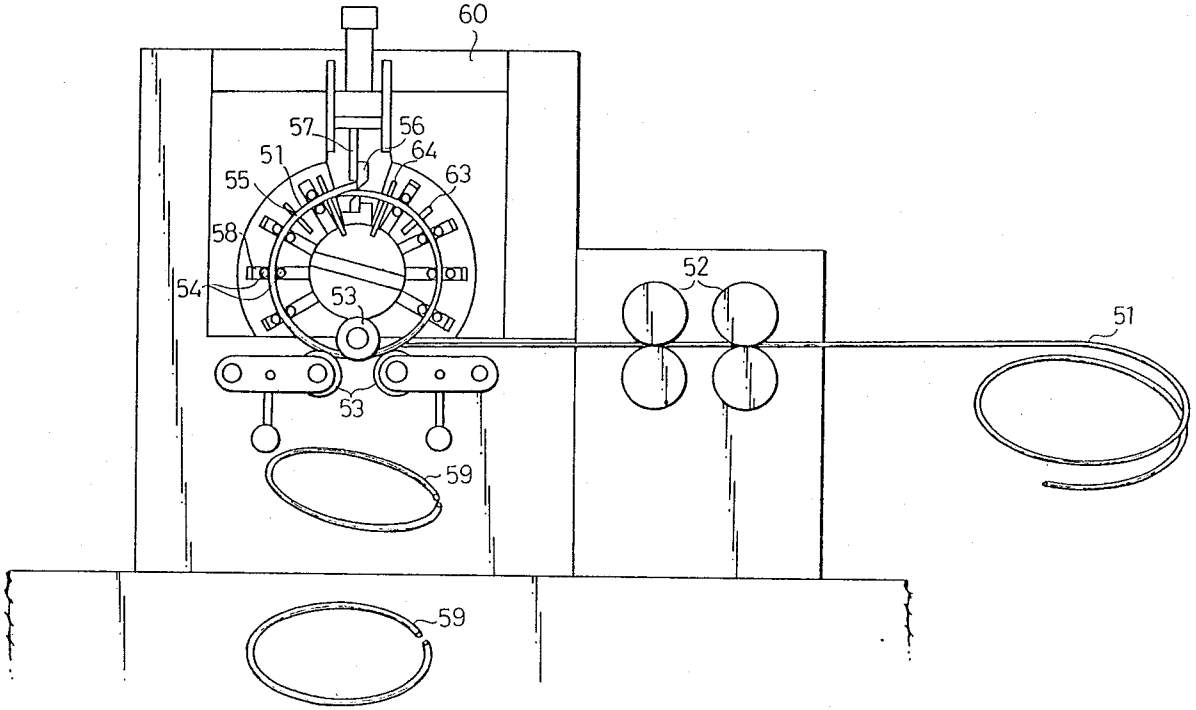
FIG. 4 is a front elevational view of an apparatus according to the related art.
Figure 6:
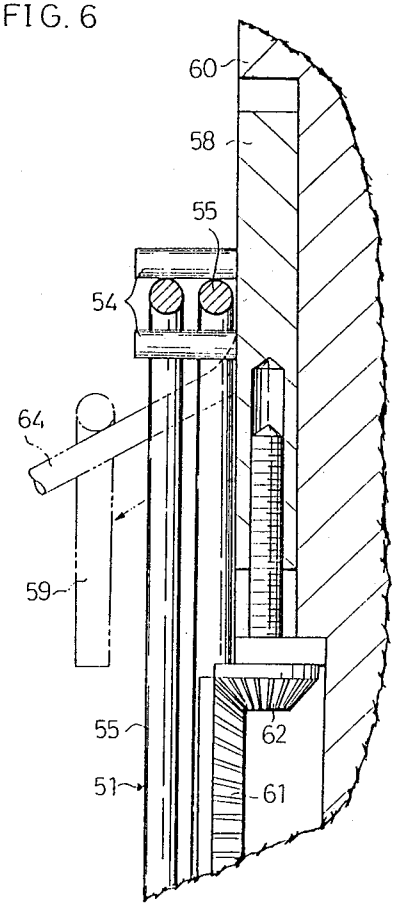
FIG. 6 is a cross-sectional view taken along line VI—VI of FIG. 5.
Figure 5:
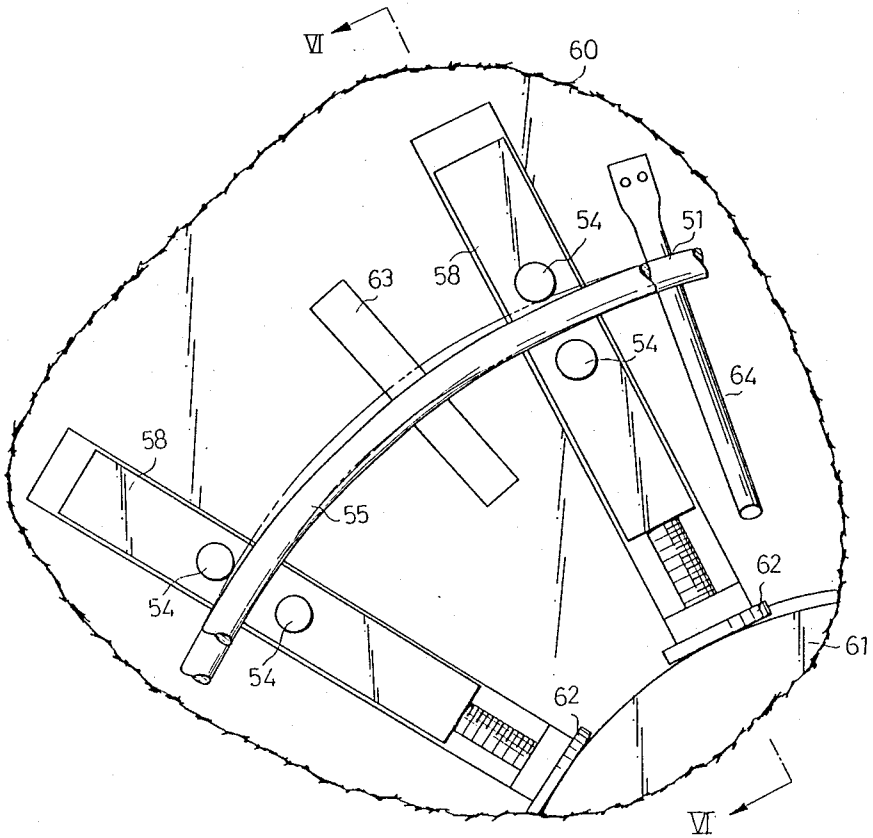
FIG. 5 is an enlarged fragmentary front elevational view showing the manner in which a coiled portion is guided by guide members in the related art.

FIG. 3 shows an apparatus according to a second embodiment of the present invention.

The feeding means 103 has two pairs of feed rollers 11 mounted on a base 7 for gripping and feeding an elongate workpiece 1. The feed rollers 11 are rotated and stopped by a servomotor 26. The measuring means 102 has a pair of measuring rollers 24 disposed near the feed rollers 11 and rotatable in contact with the elongate workpiece 1 as the workpiece 1 moves. One of the measuring rollers 24 outputs an electric signal indicative of the number of revolutions thereof to a processor 25 mounted on the base 12. The processor 25 stores the number of revolutions of the measuring roller 24 which correspond to the length of the elongate workpiece 1 that is equal to the circumferential length of the ring-shaped member 2. When the detected number of revolutions is equalized to the stored number of revolutions, the processor 25 outputs a signal to the servomotor 26 to stop the servomotor 26 and hence the feed rollers 11. Therefore, the elongate workpiece 1 is fed along for the length equal to the circumferential length of the ring-shaped member 2. The measuring roller 24, the processor 25, and the servomotor 26 jointly constitute control means 106 for controlling the rotation of the feed rollers 11.

The other details of the apparatus than the feeding means 103 and the measuring means 102 are the same as those of the apparatus according to the first embodiment.

Also in this embodiment, the elongate workpiece 1 is fed to the coiling means 104 for the length equal to the circumferential length of the ring-shaped member 2 during an interval after the feed rollers 11 start rotating and until they stop rotating. Therefore, any variations in the circumferential lengths of produced ring-shaped members 2 are much smaller than those of the ring-shaped members manufactured by the apparatus of the related art.

The present invention is not limited to the aforesaid embodiments, but may be modified in the following manner:

(1) A plurality of aligned straightening means 101 may be provided. In this case, the axes of the straightening rollers 4 may be turned 90° from those of the foregoing embodiments about the path of the elongate workpiece 1, so that the axes of the straightening rollers 4 will extend vertically in FIG. 1(*b*) for straightening the elongate workpiece 1 out of the curved shape more easily.

(2) Two grip means 9 may be provided in the first embodiment. A front one of the grip means 9 grips the elongate workpiece 1 and moves therewith until it abuts against the stopper 19, whereupon the other rear grip means 9 grips the elongate workpiece 1. At the same time that the rear grip means 9 is advanced, the front grip means 9 is retracted by the air cylinder 18 and then grips the elongate workpiece 1. This cycle of operation is repeated. The cycle of feeding the elongate workpiece 1 can thus be shortened.

(3) The distances between the three feed rollers 13 may be adjusted to adjust the extent to which the leading end portion of the elongate workpiece 1 is curved.

(4) The moving means 23 of the cutting means 105 may be an air cylinder or any of various other mechanical means.

Although certain preferred embodiments have been shown and described, it should be understood that many changes and modifications may be made therein without departing from the scope of the appended claims.

What is claimed is:

1. An apparatus for manufacturing a ring-shaped member from an elongate workpiece, comprising:

(a) straightening means for straightening a coiled elongate workpiece, said means including rollers disposed in a zigzag pattern, said coiled elongate workpiece passing through and between said rollers so as to be straightened thereby;

(b) measuring means including measuring rollers for measuring an elongate workpiece straightened by said straightening means to a specified length only by rotation of said measuring rollers in a forward direction thereof;

(c) feeding means for feeding the measured length of said elongate workpiece, said feeding means including feed rollers for feeding said elongate workpiece, and control means for controlling said feeding rollers to stop rotation thereof when said elongate workpiece has been fed for a prescribed length, said control means including said measuring rollers, said measuring rollers being in rotatable contact with said elongate workpiece as said elongate workpiece is fed by said feeding rollers, a processor to which the amount of rotation of said measuring roller is input and storing the amount of rotation of said measuring roller which corresponds to said prescribed length of said elongate workpiece, and a servomotor electrically connected to said processor for driving said feeding rollers, whereby when the stored amount of rotation and the supplied amount of rotation are equalized, said processor outputs a signal to said servomotor to stop said servomotor and said feeding rollers;

(d) coiling means having bending rollers for bending said elongate workpiece fed by said feeding means to a curved shape; a plurality of pairs of guide pins provided along a circular moving locus of a leading end portion of said elongate workpiece bent by said bending rollers, each pair of said guide pins sandwiching and guiding said leading end portion of the bent elongate workpiece to form a coiled portion from said elongate workpiece; and a plurality of guide members extending in a radial direction of said circular moving locus, each said guide member being slidable in said radial direction, each said pair of guide pins being provided on a said guide member so as to be adjustable in position in said radial direction so as to correspond to a change of a radius of said coiled portion; and (e) cutting means for cutting the coiled portion off said elongate workpiece into a ring-shaped member.

* * * * *